United States Patent [19]

Sos et al.

[11] Patent Number: 4,817,399

[45] Date of Patent: Apr. 4, 1989

[54] KNITTING TOOL FOR TEXTILE MACHINES, PARTICULARLY KNITTING MACHINES

[75] Inventors: Sigmund Sos; Ferdinand Schuller, both of Albstadt, Fed. Rep. of Germany

[73] Assignee: Theodor Groz & Söhne & Ernst Beckert Nadelfabrik Commandit-Gesellschaft, Albstadt-Ebingen, Fed. Rep. of Germany

[21] Appl. No.: 191,982

[22] Filed: May 9, 1988

[30] Foreign Application Priority Data

May 7, 1987 [DE] Fed. Rep. of Germany... 8706530[U]

[51] Int. Cl.[4] ..... D04B 35/04

[52] U.S. Cl. ..... 66/123

[58] Field of Search ..... 66/121, 123

[56] References Cited

U.S. PATENT DOCUMENTS 2,431,635 11/1947 Currier .

4,562,705 1/1986 Berentzen ..... 66/121

FOREIGN PATENT DOCUMENTS 2553547 6/1976 Fed. Rep. of Germany .

2610078 9/1977 Fed. Rep. of Germany ..... 66/123

3314809 10/1984 Fed. Rep. of Germany ..... 66/121

57-9433 2/1982 Japan ..... 66/123

*Primary Examiner*—Ronald Feldbaum

*Attorney, Agent, or Firm*—Spencer & Frank

[57] ABSTRACT

A stamped knitting tool for textile machines and particularly for knitting machines is provided with a shank member and a working member. The shank member includes upper and lower edges and first and second end surfaces, and has at least one butt extending from one of the edges and a recess defined in the first end surface and laterally bounded by a web portion of the shank member on each side. The recess is divided into a guide region adjacent the first end surface and a following anchorage region at the rear, and the edges of the web portions facing recess have an irregular profile in the anchorage region. The working member has a needle head or needle hook disposed at one end and a connecting member portion disposed at the other end, with the connecting member portion being positioned in the recess of the shank member so that it is held in a form-locking manner by the web portions in the guide region and so that it is anchored to the shank member in the anchorage region. To provide the anchoring in the anchorage region at least one open space is provided in the anchorage region between the connecting member portion and the adjacent edge or edges of the shank member defining the recess, and a vibration damping material fills the open space and firmly connects the connecting member portion to the shank member.

18 Claims, 2 Drawing Sheets

KNITTING TOOL FOR TEXTILE MACHINES, PARTICULARLY KNITTING MACHINES

BACKGROUND OF THE INVENTION

1. Field of the Invention

The present invention relates to a punched or stamped knitting tool for textile machines, particularly knitting machines of the type which include a shank member and a removable/replaceable working member.

More particularly the present invention relates to a knitting tool of the above type wherein the shank member has at least one butt and is provided at one end with a recess having an open edge at the frontal end surface, with this recess being laterally bounded by two web portions which are provided with an irregular profile on a portion of the sides which face the recess; wherein the working member is equipped with a needle head or needle hook at one end and a shank-like connecting member portion at the other end, with the connecting member portion, which is also provided with an irregular profile on a portion of the sides which face the recess, being adapted to be fitted in the shank member so that it is guided between the web portions in a form-locking manner along a guide region of the recess adjacent the frontal end surface of the shank member; and wherein the connecting member portion is anchored in the shank member in a subsequent anchorage region of the recess which includes the irregular profiles of the connecting member portion and of the web portions.

The term "knitting tool" as used in this application is intended to include latch needles, spring beard needles, composite needles, needles without latches, for example plush hooks for the production of plush goods, as well as sinkers.

2. Discussion of the Prior Art

U.S. Pat. No. 2,431,635 discloses a latch needle for knitting machines which includes the features listed above. In this latch needle, the needle butt and the needle hook are located on separate shank-like members, namely the actual shank member and a needle or general working member. The shank member and the working member are connected to one another so that one end region of the working member, which is formed with a connecting member portion, is pressed into an open-edge recess facing the frontal face in the shank member and is rigidly anchored therein by the meshing of part of the profiles of the connecting member portion and the shank member. The reason for this two-part configuration of the latch needle is that it provides a simple opportunity to exchange a damaged working member or shank member for a new one without having to discard the entire needle. For this reason, the connection between the working member and the shank member is made releasable by allowing the connecting member portion to be simply pressed laterally out of the recess. These releasable two part needles suffer from a number of disadvantages and problems.

Initially, it must be pointed out that at the present time the taking-apart and putting-together of individual needle members is no longer practicable because of the labor costs incurred by the user of a knitting machine. Moreover, there is also the danger in modern high-speed knitting machines that the rigid connection between the shank member and the working member would allow vibrations originating from the control strokes exerted by lock members on the base of the shank member to be transferred to the needle hook without damping, and would therefore cause hook breakage. Finally, the profiles of the connecting member portion and the web portions which delimit the recess must be configured with very close tolerances so that they mesh reliably to prevent the occurrence of even the slightest amount of play between the parts. Due to the control strokes, any such play would quickly lead to the profiles coming apart and thus to an unreliable connection between the working member and the shank member.

German Pat. No. 2,610,078 discloses a latch needle for knitting machines where the needle butt and the needle head are configured on separate needle shank members which are connected to one another by way of intermediate damping members. According to the disclosed arrangement, the needle shank members are positioned against one another along opposing faces extending in the displacement direction of the latch needle and are connected to one another by meshing dovetail-like connecting elements. Elastic intermediate members are located between the opposing faces of these connecting elements where their faces do not extend in the longitudinal direction of the needle. These elastic intermediate members are made of a synthetic rubber, and are firmly anchored either by a simple form-locking connection between the coupled needle shank members or merely at the frontal face of one of the two needle shank members. Due to the small shank thickness and height of the shank members, and thus the small cross-sectional area resulting from these dimensions (for example, the average needle has a cross-sectional area of 0.6 $mm^2$), the operationally reliable mounting of the rubber intermediate members between the coupled-together shank members poses problems. This is particularly true in the case of the connection for fine needles. Additionally, there exists the danger that the highly elastic rubber intermediate members will become plastically deformed, i.e. compressed, for example. The plastic deformation occurs due to movement of the needles during the knitting process and the deformation may occur to such an extent that the operating length of the entire needle is subjected to change. This change in the operating length of the needle results in a knit product which has an irregularly knit appearance.

In practice, a plurality of different variations of knitting machine needles and also sinkers and other knitting tools are currently in use. The variation utilized depends on the respective intended use and the respective type of machine. This multitude of variations requires great expenditures for the manufacturer, not the least of which are the various stocks that have to be maintained.

SUMMARY OF THE INVENTION

It is an object of the present invention to help reduce this multitude of variations by providing a punched or stamped knitting tool for textile machines, particularly for knitting machines, which allows the user to: (1) reduce the number of separately produced and stocked elements because of the fact that working members and shank members can be combined by the user to meet the many different knitting tool variations; and (2) elastically connect the working member and the shank member in a manner such that the resulting knitting tool can be used reliably over long periods of operation and maintained relatively free from permanent irreparable breaks, for example breaks at the needle head or hook.

The above and other objects are achieved by the present invention in that in a stamped knitting tool for textile machines, particularly knitting machines, including a shank member having upper and lower edges and first and second end surfaces, at least one butt extending from one of the edges, and an axially extending recess defined in the first end surface so that the recess is laterally bounded by a web portion of the shank member on each side, with each respective web portion having a facing edge which faces the recess (which is divided into a guide region adjacent to the first end surface and a following anchorage region), and has an irregular profile in the anchorage region, and a working member having a needle head or needle hook disposed at one end and a shank-like connecting member portion disposed at the other end, with the connecting member portion being positioned in the recess of the shank member so that it extends through the guide region and into the anchorage region, being shaped so that it is guided in a form-locking manner by the facing edges of the web portions in the guide region, and having opposing edges containing an irregular profile in the region corresponding to said anchorage region;

the web portions and the connecting member portion are shaped so that at least one open space is formed in the anchorage region between an edge of the connecting member portion and the adjacent edge of the shank member defining the recess, and this open space is filled with a vibration damping material which is firmly anchored to both the connecting member portion and to the shank member with an unreleasable connection.

In the present knitting tool, while the working member is precisely guided in exactly the correct position in the guide region of the recess of the shank member, the vibration damping material filling the open space simultaneously ensures that no vibrations originating from the control strokes exerted on the butt by the lock members can reach the end of the working member without being damped. Since the web portions of the shank member and the connecting member portion of the working member have an irregular profile in the anchorage region, the vibration damping material filling the open space is properly anchored to the shank member and the connecting member portion. The irregular profiles provide an additional form-locking anchorage for the vibration damping material.

In a preferred embodiment, the arrangement is made such that in the anchorage region the connecting member portion is spaced from the edge of the shank member defining the rear of the recess and from the web portions essentially along their entire length, whereby the open space essentially surrounds the connecting member in the anchorage region of the recess, so that a large anchorage surface area is available for the vibration damping material. By suitably dimensioning the open space filled with vibration damping material, the elastic characteristics of the knitting tool can also be adapted to the respective conditions of use.

It has been found to be advantageous for the irregular profiles of the connecting member portion and/or the web portions to have regions of reduced wall thickness which project into the material filling the open space. These reduced wall thickness regions may border the associated edges of the connecting member portion and/or web portions in a strip-like manner but it is particularly advantageous if they are limited to specific locations of the irregular profile. The reduced wall thickness regions may also be located along the longitudinal center plane of the shank member and symmetrically disposed relative to the lateral side surfaces of the shank member and thus provide additional anchorage surfaces for the vibration damping material extending into and filling the recesses.

To increase the stability of the connection between the working member and the shank member, it is preferable for the working member to have shoulders which rest flush against the frontal surface of the shank member. Moreover, the web portions of the shank member may also be connected with the shoulders of the working member in a form-locking manner. This provides an additional hold between the end of the web portions and the working member. In a practical embodiment, the shoulders may include recesses into which projections formed at the end surfaces of the web portions engage.

It is also advantageous if the outer edge surfaces of the shoulders are flush with the upper and lower edges of the shank member so that there are no abrupt transitions between the working member and the shank member in the region of the connection. Such abrupt transitions would interfere with the smooth movement of the needle in the needle bed and can allow dirt to accumulate.

The vibration damping material is generally composed of a plastic or a synthetic resin which ensures a firm adhesive bond between the respective anchorage faces of the working member, web portions and the rear of the recess.

Preferably the connecting member portion is laterally bounded on its parallel upper and lower surfaces, at least in a guide region, by the web portions of the shank member which have a height of at most 1.1 mm. Thus the web portions are distinguished by particularly high elasticity. This extremely narrow configuration of the web portions has been found to permit the realization of very effective damping of the vibrations introduced at the butt. In this connection it has been found advantageous for the axial length of the guide region to be at least 1/5 of the axial length of the recess.

It has also been found to be advantageous for the lateral height of connecting member portion to be smaller in the anchorage region than in the guide region. This difference helps create the open space to accommodate the vibration damping material. However, another arrangement is also possible where the lateral height of the recess is larger in the anchorage region than in the guide region. It is also conceivable to use both of these situations such that the lateral height of the connecting member portion is smaller in the anchorage region than in the guide region and the lateral height of the recess is larger in the anchorage region than in the guide region.

In certain cases, such as transfer needles, considerable lateral forces act on the working member. In this case it may be advisable to weld the working member to the shank member, at least in specific locations or spots in the guide region and/or in a region adjacent thereto.

The welding of the working member to the guide member is preferably done by means of a laser. This welding reliably prevents the laterally acting forces from pressing the working member laterally out of the associated recess in the shank member in the guide region. The spot welding increases the stability of the knitting tool and allows the above described advantages of the two-part knitting tool to remain in effect. In particular, this applies for the vibration damping effect of the vibration damping material filling the open space.

DESCRIPTION OF THE PREFERRED EMBODIMENTS

Figure 1:
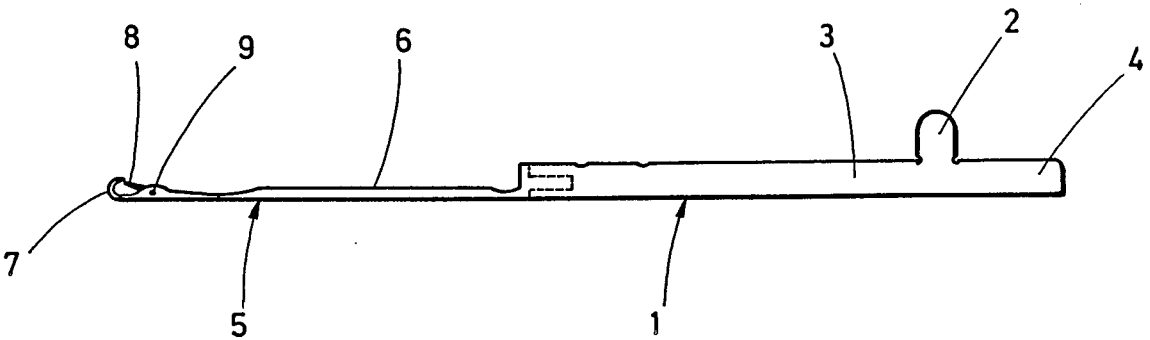
FIG. 1 is a schematic side view of the latch needle according to the invention.

FIG. 1 discloses a knitting tool in the form of a latch needle which is punched or stamped out of an appropriately thin steel sheet. The latch needle includes a shank member 1 provided with a butt 2 on its upper edge. The shank member 1 is composed of a front shank portion 3 to the left of the butt 2 and a back shank portion 4 disposed to the right of the butt as seen in FIG. 1. A separate needle or more generally, a working member 5 is connected with shank member 1. Working member 5 has a shank-like configuration at 6 and at one end contains a needle head or needle hook 7 which has an associated needle latch 8 that is pivotally mounted at 9 in a customary latch slot. Needle latch 8 is adapted to pivot around a transverse latch axis.

Figures 2, 3, 4:
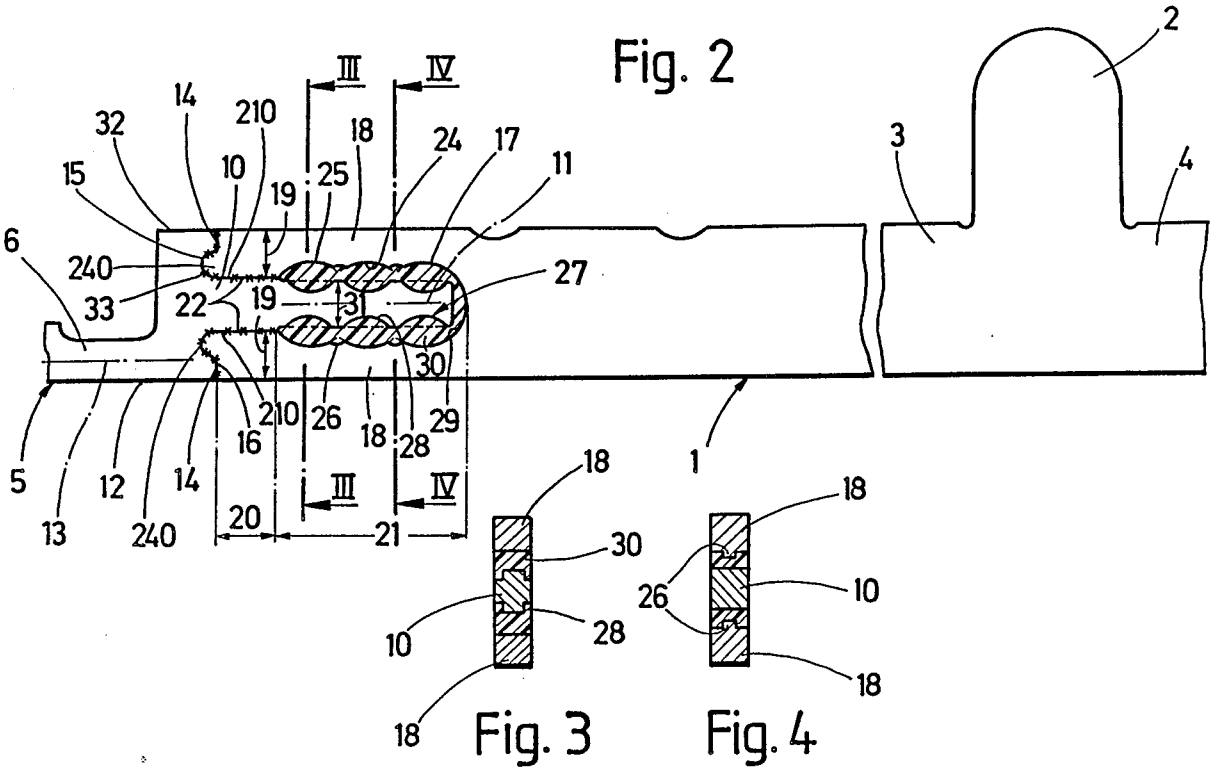
FIG. 2 is an enlarged schematic sectional side view of a portion of the latch needle according to FIG. 1 showing the region of the connection between the working member and the shank member.
FIG. 3 is a cross-sectional view of the latch needle of FIG. 2, seen along line III—III of FIG. 2.
FIG. 4 is a cross-sectional view of the latch needle of FIG. 2, seen along line IV—IV of FIG. 2.

The end of working member 5 opposite the hook 7 is provided with a shank or pin-like connecting member portion which extends into a recess formed in the frontal end surface of the shank member 1 as schematically shown in FIG. 1 and as shown in detail in FIG. 2. As can be clearly seen from FIG. 2, the shank or pin-like connecting member portion 10 has an essentially rectangular configuration and its longitudinal axis 11 is oriented parallel to the back 12 of the working member 5. In the embodiment illustrated in FIG. 2, working member 5 has its longitudinal center axis 13 vertically offset with respect to the longitudinal axis 11 of connecting member portion 10. Other embodiments are also conceivable where the two axes 11 and 13 are coextensive with one another. On the upper and lower lateral sides of connecting member portion 10, there extend two shoulders 14 which are part of working member 5. These shoulders 14 extend at approximately right angles to the lateral edges of connecting member portion 10. In the surface of each shoulder 14 which faces the shank member 1 there is disposed an approximately segment-shaped recess 15, preferably at the transition to the connecting member portion 10 as shown.

The frontal or end surface 16 of the shank member 1 facing the working member 5 has an axially extending recess 17 formed therein, with the recess 17 being laterally bounded by two web portions 18 of the shank member 1. The web portions 18 have a height 19 which is preferably at most 1.1 mm. Both web portions 18 have the same height so that the recess 17 lies symmetrically on either side of the longitudinal center axis 11 of the shank member 1.

Recess 17 includes a guide region 20 adjacent end surface 16 which is delimited by two facing, mutually parallel edge zones 210 of web portions 18 which are associated with correspondingly parallel, smooth edge zones 22 of connecting member portion 10. The arrangement is such that in guide region 20, connecting member portion 10 is snugly fitted, i.e., without play, in recess 17. In the assembled state as shown, shoulders 14 of working member 5 are flush against the frontal end surface 16 of shank member 1, and more precisely, of web portions 18. Moreover, as further shown, projections 240, which are disposed at the ends of the web portions 18 and are configure to correspond to the shape of recesses 15, engage in a form-locking manner in these recesses 15.

The recess 17 further includes an anchorage region 21 which is adjacent to and follows the guide region 20. In anchorage region 21, the edges of web portions 18 facing recess 17 are provided with an irregular profile 24. Irregular profile 24 is composed of successive arcuate profile sections 25 which are in a scallop-like configuration. At the point of intersection with adjacent profiled sections 25, the irregular profile 24 contains regions of reduced wall thickness 26 (FIG. 4) which are located along the longitudinal center plane of the shank member 1 and are symmetrically disposed relative to the lateral side surfaces of the shank member.

Connecting member portion 10 also contains an irregular profile 27 along the section of its upper and lower edges disposed in anchorage region 21. In the illustrated embodiment, this profile 27 is composed of juxtaposed arcuate groove-like recesses which are symmetrically disposed relative to the longitudinal center plane of connection member portion 10 and of shank member 1 to produce sections of reduced wall thickness 28 (see FIG. 3).

Between connecting member portion 10 and web portions 18, an open space 29 exists in anchorage region 21 which can be seen in FIG. 2. Open space 29 surrounds connecting member portion 10 in anchorage region 21 essentially along its entire edge so that the connecting member portion 10 is spaced from the web portions 18 and the rear of the recess 17. This open space 29 is filled with a vibration damping material 30 which is composed of a plastic or a synthetic resin and which firmly adheres to the edge surfaces bordering the open space 29, including the anchorage surfaces formed by profiles 24 and 27. The vibration damping material 30 thus forms a firm connection between the connection member portion 10 and the web portions 18 as well as the edge of shank member 5 at the rear of recess 17. As can be seen in FIGS. 3 and 4, the vibration damping material 30 not only contacts the regions of reduced wall thickness 26, 28 but also extends out to the width of connecting member portion 10 and web portions 18 so that an additional form-locking anchorage is accomplished.

To enlarge open space 29, connecting member portion 10 preferably is configured such that its height 31 in anchorage region 2 is less than its height in guide region 20. At the same time, the arcuate profile sections 25 in anchorage region 21 cause recess 17 to be wider toward the upper and lower edges of shank member 1 and thus the height of the recess 17 is larger in the anchorage region 21 than in the guide region 20.

The shoulders 14 of working member 5 are configured such that the upper edge 32 and the back 12 of working member 5 are flush with the upper and lower edges of shank member 1, see FIG. 2. This means that there is no abrupt step at the point of connection between working member 5 and shank member 1.

Additionally, the axial length of guide region 20 is dimensioned so that it amounts to at least 1/5 of the total axial length of recess 17.

Shank member 1 and working member 5 are manufactured separately, with the arrangement and configuration of the butt 2 (or possibly a plurality of butts), the front shank 3, the back shank 4, etc. of shank member 1, and of the shank region 6 and the needle head, including latch 9, of working member 5 being configured according to the circumstances required for the respective needle application. Only in the region of recess 17 of connecting member 10 are shank member 1 and working member 5 similar.

This allows the manufacturer to combine various shank members 1 and working members 5 according to the desired needle variation so that they have the same working length. To do this, the user inserts the connecting member portion 10 of the respective working member 5 into the recess 17 of the associated shank member 1 and anchor it therein by introducing the vibration damping material 30 into the open space 29. The respective edge surfaces 210 and 22 of web portions 18 and connecting member portion 10 are held together in a form-locking manner in recess 17. Since the respective edge surfaces are positioned against one another without any play in guide region 20, they ensure accurate guidance of working member 5 in shank member 1. The flush contact of shoulders 14 at frontal surfaces 16 of shank member 1 also ensures accurate guidance of working member 5 in shank member 1, thereby ensuring exactly the same working length for all needles. The vibration damping material 30 surrounding connecting member portion 10 in anchorage region 21 ensures that shock waves initiated at butt 2 are damped and cannot cause needle hook 7 to break. This effect is also enhanced by the extremely small height of web portions 18. The described configuration of guide region 20 ensures that precise guidance of working member 5 is always maintained at shank member 1.

Additional measures may occasionally be appropriate in cases where considerable lateral forces, which act at a right angle to the plane of the drawing of FIG. 2, are exerted on working member 5 during its use. These lateral forces may cause working member 5 and its connecting member portion 10 to be laterally pivoted out of recess 17 and particularly out of guide region 20. This would mean that edge surfaces 210 and 22 are partially separated. This would also mean the release of the ends of web portions 18 from recesses 15, and thus the form-locking connection would no longer exist.

To avoid this, working member 5 and shank member 1 may be welded together, for example by spot welding at certain locations in guide region 20 and/or in the region of shoulders 14, frontal surfaces 16 and recesses 15. Laser welding appears to be particularly useful for this purpose. This measure does not considerably influence the flexibility of web portion 18 over the entire length of anchorage region 21, so that the effect of the vibration damping material in recess 17 remains in effect. In FIG. 2, the welding locations are indicated by reference numeral 33.

The present disclosure relates to the subject matter disclosed in German Application No. G 87 06 530.4 of May 7th, 1987, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A stamped knitting tool for textile machines, particularly knitting machines, said tool including:

a shank member having upper and lower edges and first and second end surfaces, said shank member further having at least one butt extending from one of said edges and an axially extending recess defined in said first end surface so that said recess is laterally bounded by a web portion of said shank member on each side, each respective said web portion having a facing edge which faces the recess which is divided into a guide region adjacent to said first end surface and a following anchorage region, and each of said facing edges has an irregular profile in said anchorage region; and a working member having a needle head or needle hook disposed at one end and a shank-like connecting member portion disposed at the other end, with said connecting member portion being positioned in the recess of said shank member so that it extends through said guide region and into said anchorage region, being shaped so that it is guided in a form-locking manner by said facing edges of said web portions in said guide region, and having opposing edges containing an irregular profile in the region corresponding to said anchorage region; the improvement wherein:

said web portions and said connecting member portion are shaped so that at least one open space is formed in said anchorage region between an edge of said connecting member portion and the adjacent edge of the shank member defining the recess; and a vibration damping material fills said open space and firmly connects said connecting member portion to said shank member, to anchor said working member in said shank member.

2. A stamped knitting tool as defined in claim 1, wherein said connecting member portion is spaced from the edges of said shank member defining said recess in said anchorage region so that said open space extends essentially along all of the edges of said connecting member in said anchorage region.

3. Stamped knitting tool as defined in claim 1, wherein said irregular profiles of at least one of said connecting member portion and said web portions includes regions of said edges which have a reduced thickness and which project into said vibration damping material filling said open space.

4. A stamped knitting tool as defined in claim 3, wherein said regions of reduced thickness are restricted to specific locations of said irregular profile.

5. A stamped knitting tool as defined in claim 3, wherein said regions of reduced thickness are located along the longitudinal center plane of said shank member and are symmetrically disposed relative to the lateral side surfaces of said shank member.

6. A stamped knitting tool as defined in claim 1, wherein said working member further includes shoulders disposed laterally of said connecting member portion which abut against said first end surface of said shank member.

7. A stamped knitting tool as defined in claim 6, wherein said web portions of said shank member connect to said shoulders of said working member in a form-locking manner.

8. A stamped knitting tool as defined in claim 7, wherein each said shoulder includes a recess formed therein and said web portions include projections which extend from said first end surface and engage each recess formed in said shoulder.

9. A stamped knitting tool as defined in claim 6, wherein the outer surfaces of said shoulders are flush with said upper and lower surfaces of said shank member.

10. A stamped knitting tool as defined in claim 1, wherein said vibration damping material is composed of plastic.

11. A stamped knitting tool as defined in claim 1, wherein said vibration damping material is composed of a synthetic resin.

12. A stamped knitting tool as defined in claim 1, wherein said web portions have a maximum height of 1.1 mm, and in said guide region, said connecting member portion is laterally bounded by parallel surfaces which contact said web portions.

13. A stamped knitting tool as defined in claim 1, wherein the axial length of said guide region is at least 1/5 of the axial length of the recess.

14. A stamped knitting tool as defined in claim 1, wherein the lateral height of said connecting member portion is smaller in said anchorage region than in said guide region.

15. A stamped knitting tool as defined in claim 1, wherein the lateral height of the recess is larger in said anchorage region than in said guide region.

16. A stamped knitting tool as defined in claim 1, wherein said working member is welded to said shank member at least at specific locations in said guide region.

17. A stamped knitting tool as defined in claim 6, wherein said working member is welded to said shank member at least at specific locations in between said shoulders and said first end surface.

18. A stamped knitting tool as defined in claim 17, wherein said working member is welded to said shank member at least at specific locations in said guide region.

* * * * *